US005632163A

United States Patent [19]

Inoue

[11] Patent Number: 5,632,163

[45] Date of Patent: May 27, 1997

[54] PIERCED EARRING HOLE MAINTENANCE DEVICE

[75] Inventor: Takeo Inoue, 5-23-2-704, Hiroo, Shibuya-ku, Tokyo, Japan

[73] Assignees: Kato Spring Works Co., Ltd.; Takeo Inoue, both of Tokyo, Japan

[21] Appl. No.: 357,081

[22] Filed: Dec. 15, 1994

Related U.S. Application Data

[63] Continuation of Ser. No. 997,078, Dec. 29, 1992, abandoned.

[30] Foreign Application Priority Data

| | | | |
|---|---|---|---|
| Jan. 9, 1992 | [JP] | Japan | 4-000422 U |
| Oct. 20, 1992 | [JP] | Japan | 4-073215 U |
| Dec. 14, 1992 | [JP] | Japan | 4-333297 |

[51] Int. Cl.[6] ..... A44C 7/00

[52] U.S. Cl. ..... 63/12; 63/33

[58] Field of Search ..... 63/12, 2; 24/705

[56] References Cited

U.S. PATENT DOCUMENTS

| | | | |
|---|---|---|---|
| 2,568,207 | 9/1951 | Spichu | 128/329 |
| 3,523,339 | 8/1970 | LaViano | 63/12 |
| 3,910,065 | 10/1975 | Holt | 63/12 |
| 4,067,341 | 1/1978 | Bailey et al. | 128/330 |
| 4,089,189 | 5/1978 | Verducci | 63/12 |
| 4,236,385 | 12/1980 | Block | 63/12 |
| 4,353,370 | 10/1982 | Evans | 128/129 |
| 4,593,540 | 6/1986 | Cuvar et al. | 63/12 |
| 4,771,613 | 9/1988 | Grier et al. | 63/12 |
| 4,829,788 | 5/1989 | DiDomenico | 63/12 |
| 5,018,365 | 5/1991 | Luceno | 62/12 |
| 5,020,338 | 6/1991 | Payne et al. | 63/12 |
| 5,076,072 | 12/1991 | Payne | 63/12 |
| 5,154,068 | 10/1992 | DiDomenico | 63/12 |

FOREIGN PATENT DOCUMENTS

| | | |
|---|---|---|
| 0276197 | 7/1988 | European Pat. Off. . |
| 1247653 | 9/1971 | United Kingdom . |
| 2239781 | 7/1991 | United Kingdom . |
| 2241148 | 8/1991 | United Kingdom . |
| WOA-87/06143 | 10/1987 | WIPO . |

*Primary Examiner*—Michael J. Milano
*Attorney, Agent, or Firm*—Darby & Darby

[57] ABSTRACT

The present invention offers a pierced earring hole maintenance device with which it is possible to safely and hygienically maintain a small opening formed in the earlobe or the like for the purpose of attaching a pierced earring therein. The pierced earring hole maintenance device of the present invention consists of a resin material and comprises a rod portion, insertable into the small pierced earring hole formed to a position on the earlobe or the like, and a flange portion, provided to one end of the rod and having a maximum width greater than the size of the rod. Through the attachment of the pierced earring maintenance device of the present invention in the small hole formed at the position of attachment of a pierced earring to the earlobe or the like, it is possible to suitably maintain this small opening without causing such symptoms as skin eruptions to develop.

6 Claims, 7 Drawing Sheets

PIERCED EARRING HOLE MAINTENANCE DEVICE

This is a continuation of application Ser. No. 07/997,078, filed Dec. 29, 1992 and now abandoned.

BACKGROUND OF THE INVENTION

The present invention relates to a device for maintaining a pierced earring hole which has been formed by opening a small hole in the earlobe or the like for the purpose of attaching a pierced earring thereto. The pierced earring hole maintenance device of the present invention prevents the small pierced hole from closing up and, moreover, makes it possible to protect the skin around the small hole over a long period of time without causing skin eruptions.

Pierced earrings, which are worn by opening a small hole in the earlobe or the like, and inserting a post through the pierced hole, enjoy great popularity with women in particular.

The procedure for opening a small hole in the earlobe or the like is normally carried out by a physician. If, shortly after the procedure is performed, the pierced earring is removed and left out of the pierced hole, the pierced opening will close up. Furthermore, even in the case where considerable time has passed since the piercing procedure, if pierced earrings are not worn for an extended period of time, the small holes will gradually decrease in size. As a result, in order to wear pierced earrings again, it becomes necessary to once more undergo the piercing procedure.

Pierced earrings are normally made up of metallic pieces. For this reason, when pierced earrings are worn for an extended period of time, the wearer may develop skin eruptions or similar symptoms at the position of attachment to the earlobe or the like. These reaction symptoms may be particularly severe in the individual who has an allergic sensitivity to metals. Moreover, should cysts or abscesses develop, professional treatment becomes necessary.

Pierced earrings are not permissible in some work environments. Additionally, participation in particularly rough sports or leisure activities may necessitate removal of pierced earrings. In these type of situations, where the pierced earring is removed and left out of the small pierced hole, the wearer may encounter the aforementioned difficulties. For this reason, a solution to this problem was necessary.

SUMMARY OF THE INVENTION

Therefore, the object of the present invention is to provide a pierced earring hole maintenance device with which it is possible to maintain in a safe and hygienic manner the small pierced hole formed at the position of attachment of a pierced earring to the earlobe or like. It is an additional object of the present invention to provide a pierced earring hole maintenance device with which it is possible to easily wear a pierced earring without causing such symptoms as skin eruptions, etc., at the position of attachment to the earlobe or the like.

In order to accomplish the above objectives, the pierced earring hole maintenance device of the present invention consists of a resin material, and has a rod portion, which is insertable into the small pierced opening formed at the position of attachment of a pierced earring to the earlobe or like, and a flange portion, which is provided to one end of the rod and has a maximum width greater than the size of the rod. In a pierced earring hole maintenance device having this type of structure, the tip of the rod is inserted into the small pierced opening formed at the position of attachment of a pierced earring to the earlobe or the like. If this tip is then fixed in place by means of a fastener, it then becomes possible to ensure that the pierced earring hole maintenance device does not fall out of the position of attachment of the pierced earring. Alternatively, if the position of attachment is the earlobe, for example, the rod can be inserted from the rear of the earlobe, cut to match the individual thickness thereof, and secured in place by applying tape over the flange. Accordingly, pierced earrings can be worn in a manner almost identical to the ordinary method for warring pierced earrings and, when pierced earrings are not worn, the suitable maintenance of the small hole formed in the earlobe can be carried out through the wearing of the pierced earring hole maintenance device. Further, because the pierced earring hole maintenance device of the present invention is comprised of a resin material, it does not cause such symptoms as skin eruptions or the like. Additionally, by means of forming a liquid holding section provided in the rod, it is also possible to contain therein a medicinal substance effective in the treatment of cysts, abbesses or the like, or, conversely, it is possible to carry out expulsion of fluid penetrants from the earlobe.

Further, the structure of a maintenance device to which a pierced earring is attachable is one having a cylindrical portion where the post of the pierced earring body is inserted, this cylindrical portion having a bottom, and a flange portion provided to the opening of the cylindrical portion and having a maximum width greater than the cylindrical portion. In a pierced earring hole maintenance device of this structure, the flange portion and cylindrical portion are interposed between the pierced earring body and the position of attachment to the earlobe or the like. There is, therefore, no direct contact between the earring and the skin of the earlobe or the like, thus, the prevention of the development of such symptoms as skin eruptions or the like can be ensured. Further, the cylindrical portion is formed to be shorter than the post of the earring body, and the tip of the post is constructed so as to project out from the cylindrical portion. A fastener may be fixed to the tip of this post. In this case, even if, for example, pierced earrings having posts of differing lengths will be worn, it is not necessary to change the maintenance device, but rather is possible to respond to this situation with the same device.

A BRIEF EXPLANATION OF THE DIAGRAMS

EXPLANATION OF THE PREFERRED EMBODIMENTS

An explanation of the preferred embodiments of the present invention follows below, using as illustration the base where a pierced earring is worn on the earlobe.

Figure 1:
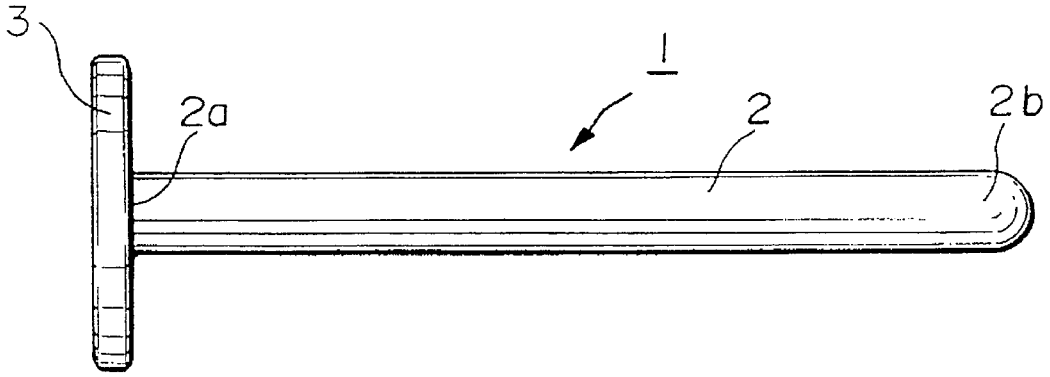
FIG. 1 is a side view showing a first embodiment of the pierced earring hole maintenance device of the present invention.

FIG. 1 is a diagram showing a first embodiment of the pierced earring hole maintenance device of the present invention. The numeral 1 in the figure indicates a pierced earring hole maintenance device consisting of a resin material harmless to humans, such as, for example, polytetrafluoroethylene, silicone, polypropylene, olefine derived elastomer, styrene derived elastomer and polyester derived elastomer.

This pierced earring hole maintenance device 1 is constructed of a rod portion 2, which has an external diameter prescribed in response to the external diameter of the pierced earring post to be worn and a fixed length corresponding to the length of the post; and a flange 3, which has a fixed diameter larger than the rod 2 at the tip 2*a* thereof. In this case, the rod portion 2 and the flange 3 may be formed in a unitary fashion, or may be threaded together through provision of female and male screw parts. Further, the tip 2*b* of the rod 2 is of a semispherical shape. This tip 2*b* of the rod 2, however, may also be of a conical or a pyramidial shape.

Figure 9:
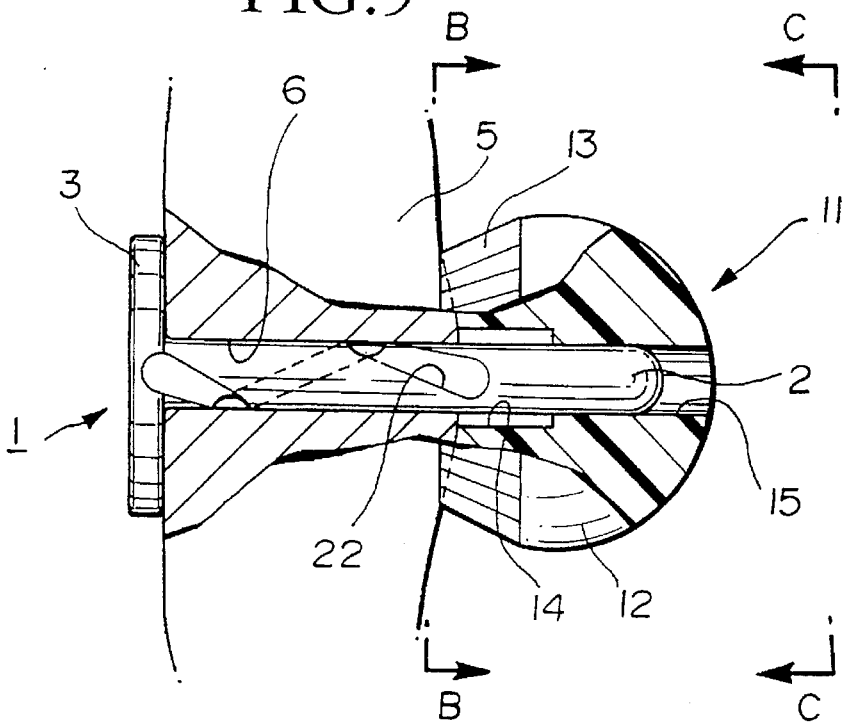
FIG. 9 is a cross sectional side view showing an example of one application of a pierced earring hole maintenance device.

As is shown in FIG. 9, a pierced earring hole maintenance device 1 consisting of a structure such as this is attached by inserting the tip 2*b* into the small hole 6 formed in the earlobe 5 (note: The pierced earring hole maintenance device shown in FIG. 9 is the second embodiment of the present invention, and will be discussed below). This wearring method is almost identical to the wearring method for an ordinary pierced earring. Additionally, a detachable fastener 11 consisting of a resin harmless to humans, such as polytetrafluoroethylene, silicone, polypropylene, olefine derived elastomer, styrene derived elastomer and polyester derived elastomer, is engaged to the tip 2*b* of the pierced earring hole maintenance device 1 which has been inserted in this fashion into the small opening 6 in the earlobe 5.

Figure 10:
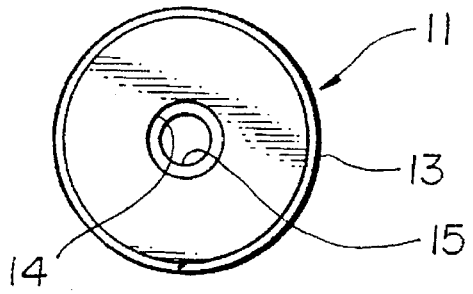
FIG. 10 is a view along the line B—B transecting the fastener in FIG. 9.
Figure 11:
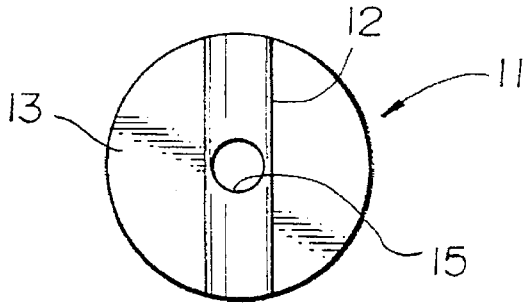
FIG. 11 is a view along the line C—C transecting the fastener in FIG. 9.

As is shown in FIGS. 10 and 11, this fastener 11 consists of a plate-shaped support 12 which can be gripped by the wearer's fingers, and a tapered whirl back 13 which is provided to the side of support 12 nearest the earlobe 5. The tapered whirl back 13 is provided with a hole which passes through the approximate center thereof. The side of the hole nearest the earlobe 5 comprises an insertion aperture 14, for insertion of the rod 2 of the pierced earring hole maintenance device 1, this insertion aperture 14 having a fixed diameter larger than the external diameter of the rod 2. The hole's other side, which is furthest from the earlobe 5, comprises an engagement aperture 15 having a fixed diameter smaller than the diameter of the insertion aperture 14 and smaller than the diameter of the rod 2. Further, a knurl is formed to the external periphery of the whirl back 13, or alternatively, the whirl back 13 may have a matte finish.

When the pierced earring hole maintenance device 1 is inserted into the earlobe 5, the earlobe 5 comes to be gripped between the fastener 11 and the flange 3 due the insertion of the tip 2*b* of the rod 2, which projects out from the earlobe 5, through insertion aperture 14 and its engagement in the engagement aperture 15. As a result, it becomes possible to maintain the pierced earring hole maintenance device 1 and the fastener 11 in a state of attachment to the earlobe 5 without dropping out thereof. In this case, due to the whirl stop 13, which is the contact surface of the fastener 11 with the earlobe 5, rotation of the fastener 11, which can cause the pierced earring hole maintenance device 1 to fall out of the earlobe 5, is eliminated and thus the pierced earring hole maintenance device 1 does not fall out of the earlobe 5. Additionally, the rod 2 can be inserted from the rear of the earlobe 5, cut to match the thickness of an individual's earlobe, and secured in place by applying tape over the flange 3, thereby omitting the use of the fastener 11.

In this manner, the pierced earring hole maintenance device 1 can be worn in the same fashion as the method for wearring an ordinary pierced earring. Moreover, by wearring the pierced earring hole maintenance device 1 in the earlobe at times when pierced earrings are not worn, it is possible to suitably maintain the small opening 6 formed in the earlobe 5. Further, because the pierced earring hole maintenance device 1 and the fastener 11 are formed of a resin material, they do not cause such symptoms as skin eruptions or the like to develop in the earlobe, making this feature particularly beneficial to individuals having an allergic sensitivity to metals.

FIGS. 2 through 7 show embodiments of the case where a liquid holding section is formed to the rod 2 of the pierced earring hole maintenance device 1 shown in FIG. 1.

Figure 2:
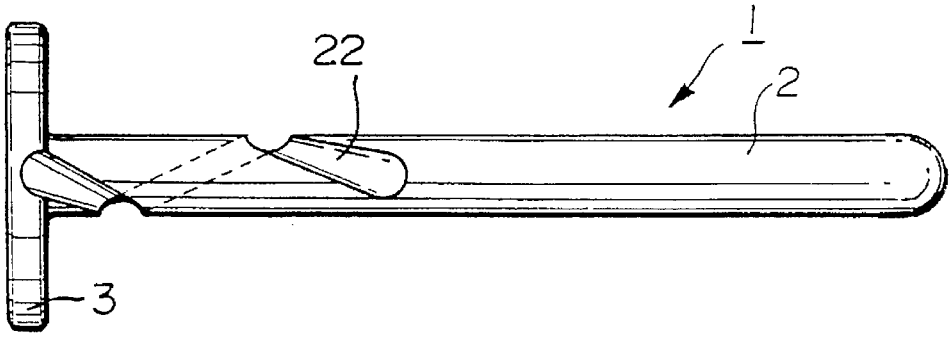
FIG. 2 is a side view showing a second embodiment of the present invention.
Figure 3:
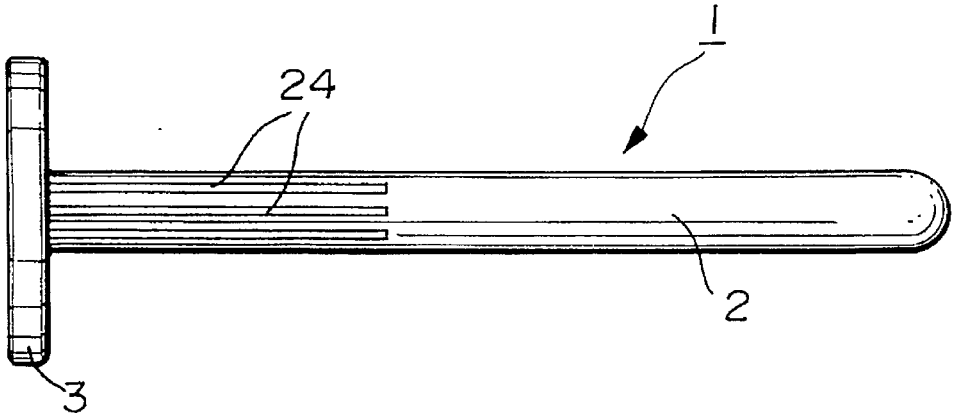
FIG. 3 is a side view showing a third embodiment of the present invention.
Figure 4:
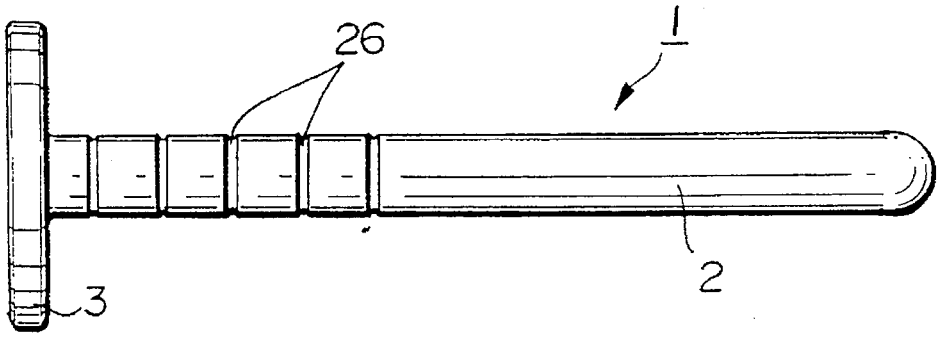
FIG. 4 is a side view showing a fourth embodiment of the present invention.
Figure 5:
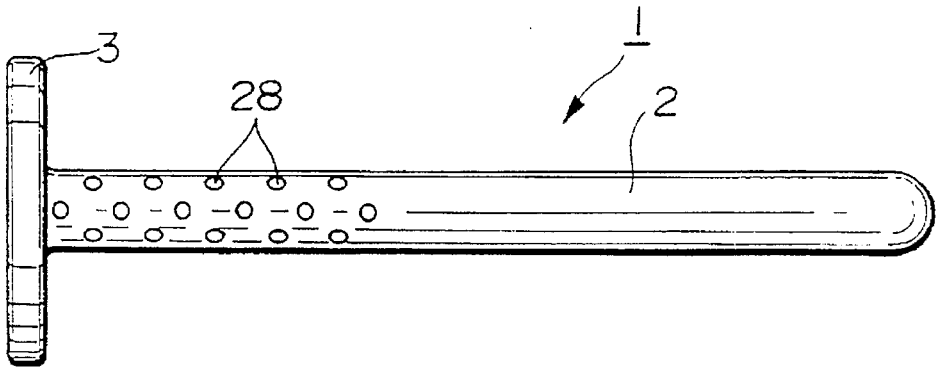
FIG. 5 is a side view showing a fifth embodiment of the present invention.
Figure 6:
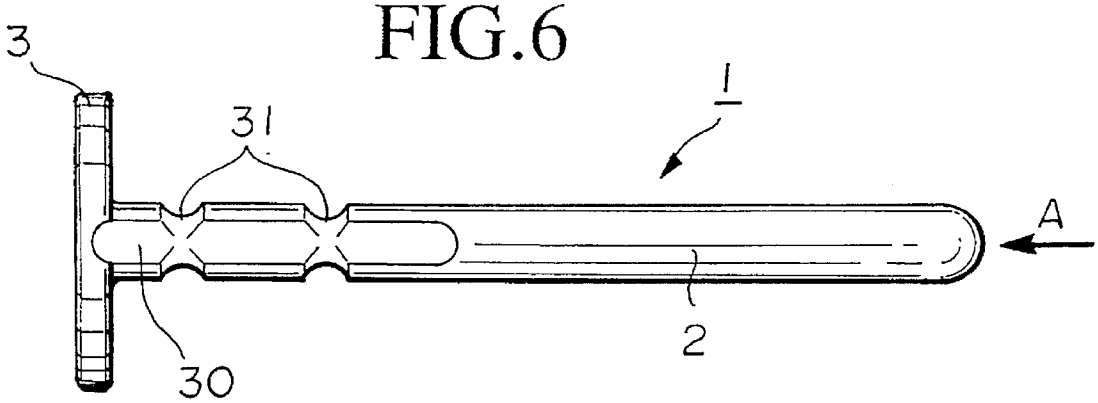
FIG. 6 is a side view showing a sixth embodiment of the present invention.
Figure 7:
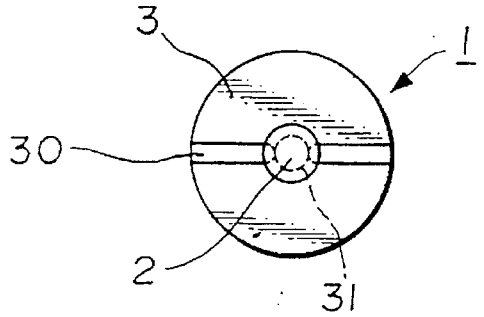
FIG. 7 is a view as seen in the direction indicated by A in FIG. 6.

In the second embodiment shown in FIG. 2, helical grooves 22 are formed to the external peripheral surface of the rod 2, and in particular, to the external peripheral surface of the portion of the rod 2 which is positioned within the small hole 6 of the earlobe 5 when the rod 2 is inserted into the small hole 6 as shown in FIG. 9. In the third embodiment shown in FIG. 3, straight grooves 24, lying along the length of the rod 2, are formed at fixed intervals about the circumference of the rod 2. In the fourth embodiment shown in FIG. 4, encircling grooves 26 are formed about the circumference of rod 2 at fixed intervals along the length thereof. In the fifth embodiment in FIG. 5, a plurality of concavities 28 are formed by indenting a portion of the external periphery of the rod 2 therewith. The sixth embodiment shown in FIGS. 6 and 7 combines the two groove types shown in FIGS. 3 and 4, that is to say, straight grooves 30 are formed at 180° intervals about the circumference of rod 2, and a pair of encircling grooves 31 are formed at fixed intervals along the length of the rod 2.

These grooves 22, 24, 26, 30, 31 and the concavities 28 construct the liquid holding section of the present invention.

Due to the formation of a liquid holding section to the external peripheral surface of the rod 2, and in particular to the portion of the rod 2 which is positioned within the small hole 6 of the earlobe 5 when the rod 2 is inserted into the small hole 6, if a medicinal substance is contained within the liquid holding section of the rod 2, and this rod 2 is then inserted into the earlobe 5, an effective method for treating earlobe inflammation, abscesses or the like can be realized. Further, if nothing is contained within the liquid holding section of the rod 2, and the rod 2 is then inserted into the earlobe 5 in this state, then it becomes possible to carry out expulsion of fluid penetrants from the earlobe to the outside via the liquid holding section.

Figure 8:
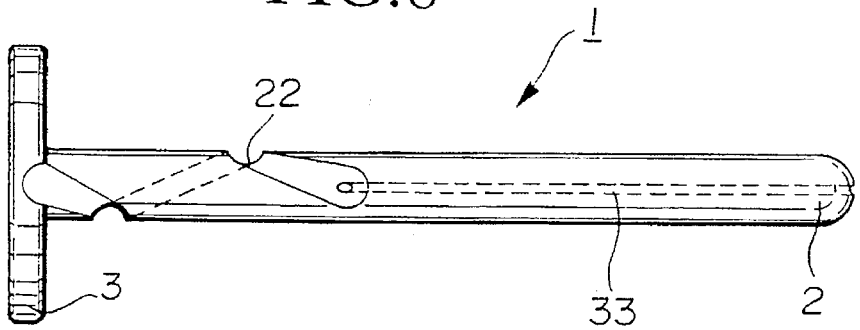
FIG. 8 is a side view showing a seventh embodiment of the present invention.

FIG. 8 shows a seventh embodiment of the present invention. In this embodiment, a communicating hole 33 which communicates with the liquid holding section is formed at the center position of the rod 2. So as to communicate with, for example, helical grooves 22, identical to those shown in FIG. 2, this communicating hole 33 is formed from the tip of rod 2 in the direction of the grooves. When formed in this manner, the injection of a medicinal substance into the liquid holding section, and the expulsion of fluid penetrants from the liquid holding section can be easily carried out by means of the insertion of the needle portion of an injector within the communicating hole 33. Additionally, the liquid holding section may be preferably formed as pictured in any of the various embodiments shown in FIGS. 2 through 7.

Figure 12:
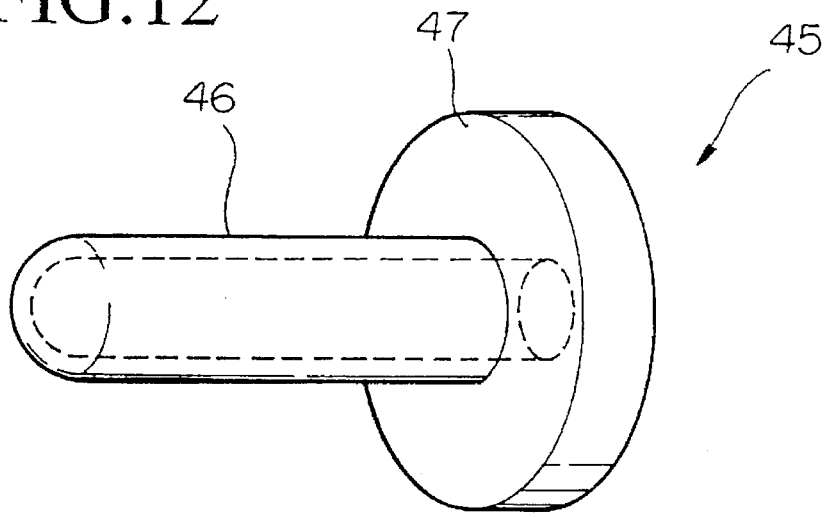
FIG. 12 is a view showing the body of the maintenance device of the eighth embodiment of the present invention.
Figure 13:
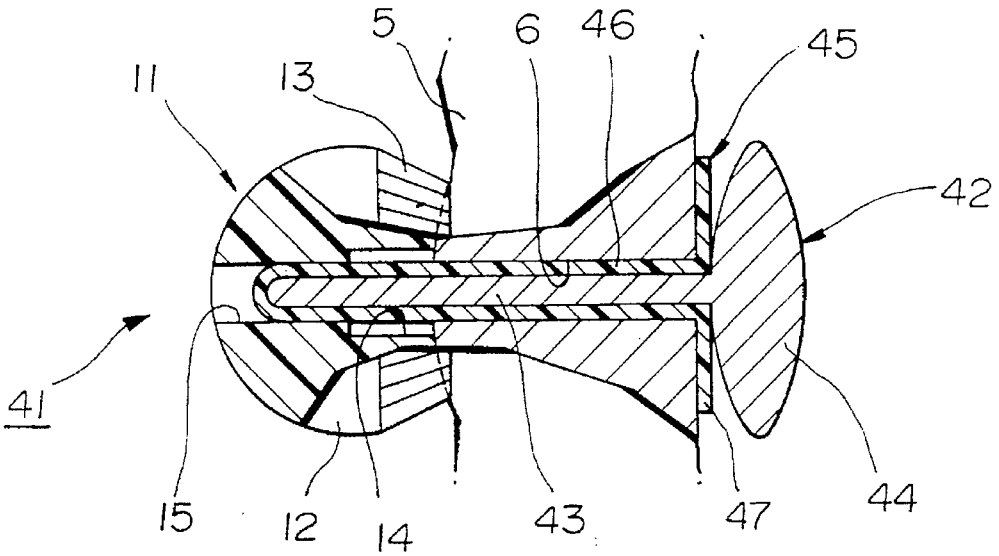
FIG. 13 is a cross sectional diagram showing the attachment of a pierced earring body to an earlobe using the pierced earring hole maintenance device of the eighth embodiment of the present invention.

The pierced earring hole maintenance device 41 according to the eighth embodiment of the present invention will be explained below with reference to FIGS. 12 and 13.

In the figures, the numeral 42 indicates the pierced earring body. The pierced earring body 42 has a post 43 and an ornamental portion 44 which is exposed on the front surface of the earlobe 5.

The numeral 45 indicates a maintenance device body consisting of a harmless resin such as Teflon, silicone, polypropylene, olefine derived elastomer, styrene derived elastomer or polyester derived elastomer. This maintenance device body 45 has a cylindrical portion 46, into which the post 43 of the pierced earring body 42 is inserted, and a flange 47. Cylindrical portion 46 is provided with a bottom, and has a depth corresponding to the length of the post 43 and has fixed inner and outer diameters, while the flange 47 is provided to the periphery of the opening of the cylindrical portion 46, and has a fixed diameter larger than that of the cylindrical portion 46 and corresponding to the ornamental portion 44 of the pierced earring body 42. Further, the end of the cylindrical portion 46 forms a semi-spherical shape.

In a thus constructed pierced earring attachable maintenance device 41, when the post 43 of the pierced earring body 42 has been inserted into the cylindrical portion 46 of the maintenance device 45 via the flange 47, by means of the insertion of the cylindrical portion 46 into the small opening 6 formed in the earlobe 5, the flange 47 and the cylindrical portion 46 are interposed between the pierced earring body 42 and the earlobe 5, thus eliminating direct contact therebetween. Accordingly, it becomes possible to easily wear the pierced earring body 42 without causing such symptoms as skin eruptions or the like to develop in the earlobe 5.

A fastener 11, having a structure identical to that shown in FIGS. 9 through 11, engages with the end of the maintenance device body 45, into which the post 43 of the pierced earring body 42 has been inserted in the above described manner.

Figure 14:
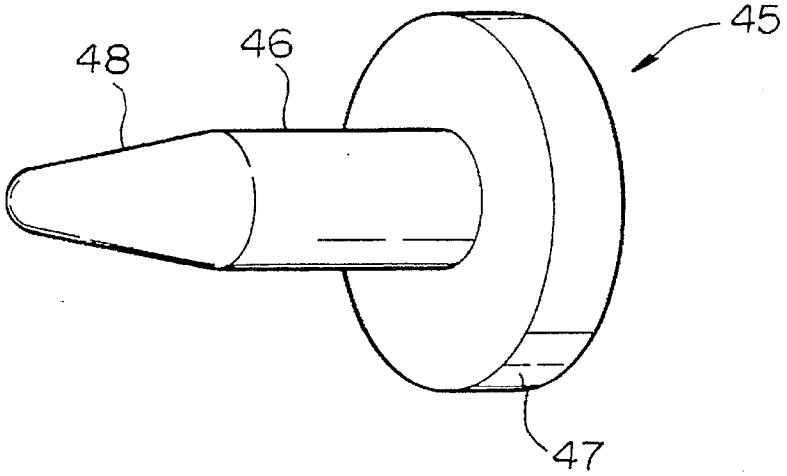
FIG. 14 is a perspective view showing an example of the tapered portion of the tip of the cylindrical portion of the body of the maintenance device of FIG. 12.

Moreover, due to the provision of a narrowly tapered portion 48, as shown in FIG. 14, at a fixed angle from a specified position on the cylindrical portion 46 of the maintenance device body 45 of the aforementioned eighth embodiment, attachability is further improved. Further, with the objective of removing the internal air when inserting the post 43 of the pierced earring body 42 into the maintenance device 45, holes or slits can be provided to, for example, the end of the cylindrical portion 46.

Next, the pierced earring attachable maintenance device according to the ninth embodiment of the present invention will be explained with reference to FIGS. 15 through 18.

Figure 15:
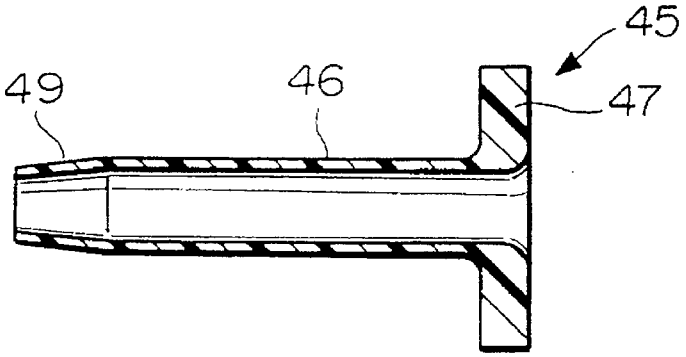
FIG. 15 is a cross sectional diagram of the maintenance device of the ninth embodiment.

As is shown in FIG. 15, the maintenance device body 45 of embodiment 9 is formed such that the end of the cylindrical portion 46 opposite flange 47, is open. Moreover, the end of the cylindrical portion 46 which is opposite the flange 47 is provided with a tapered portion 49 of a fixed length (for example, 1 mm), this tapered portion 49 having a diameter which decreases as the open end of the cylindrical portion 46 is approached. With the exception of the tapered portion 49 of the maintenance device body 45, the inner diameter of the cylindrical portion 46 is formed so as to be approximately identical (for example 0.8 mm) to the external diameter of a large post 43 in the case where there are a variety of pierced earring bodies 42 having posts 43 of differing diameters. Furthermore, the inner diameter of the open section of the tapered portion 49 is formed so as to be approximately identical (for example 0.6 mm) to the external diameter of a small post 43. Still further, excluding the flange, the axial length of the cylindrical portion 46 is formed to be longer than the thickness of the earlobe 5, but shorter than the length of a short post 43 in the case where there are a variety of pierced earring bodies 42 having posts 43 of differing axial lengths (for example 5 mm).

Figure 16:
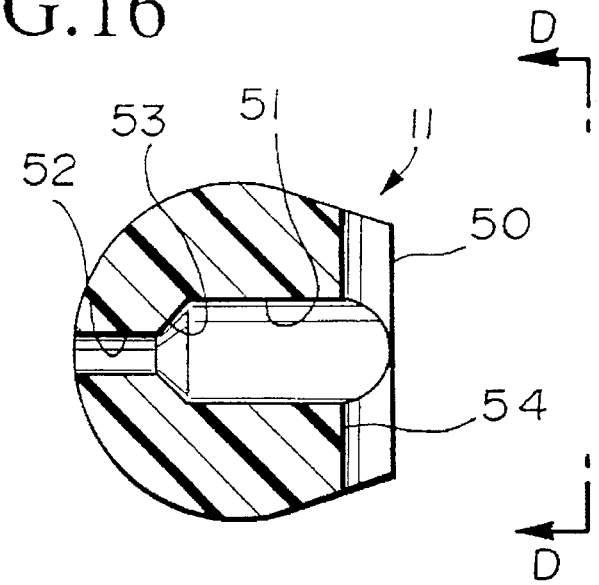
FIG. 16 is a cross sectional diagram showing an example of the fastener used with the maintenance device in FIG. 15.
Figure 17:
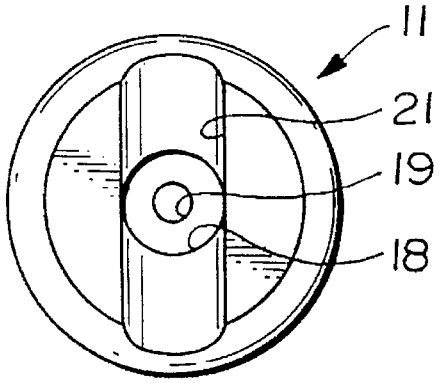
FIG. 17 is a view along the line D—D transecting the fastener of FIG. 16.
Figure 18:
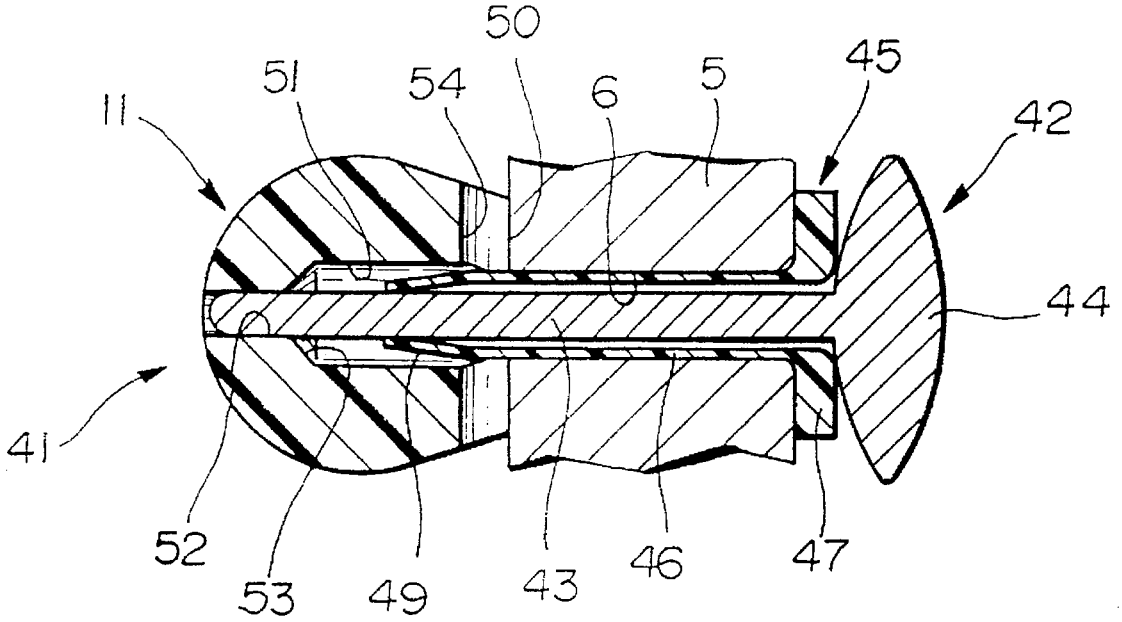
FIG. 18 is a cross sectional diagram showing the attachment of the pierced earring body to the earlobe using the pierced earring hole maintenance device of the ninth embodiment.

The fastener 11 of the ninth embodiment forms an approximate spherical shape, as is shown in FIGS. 16 and 17. A cut away surface 50 is formed to the fastener 11 by removing a portion therefrom to form a planar surface. Further, an opening is vertically formed in cut away surface 50. This opening consists of an insertion aperture 1, which is provided to the cut away surface 50 side and has a fixed diameter (for example 1.2 mm) such that the cylindrical portion 46 into which the post 43 has been inserted can be inserted thereinto with some free space remaining; an engaging hole 52, which is provided to the side opposite the cut away surface 50 and has a fixed diameter (for example, 0.5 mm) smaller than the post 43 of the pierced earring body 42; and a tapered portion 53 which is provided between the insertion aperture 51 and the engaging hole 52. Further, grooves 54, which contain insertion aperture 51 and which are recessed along the radial direction to form a cross sectional semi-circular shape in the cut away surface 50, are formed to the cut away surface 50.

The combined axial depth of the insertion aperture 51 and the tapered hole 53 is set so that the tapered portion 49 does not come in contact with the tapered hole 53 until (or even when) the earlobe 5 is gripped between the flange 46 and the fastener 11 by inserting the maintenance device 45, into which a pierced earring body 42 has been inserted, into the earlobe 5 and engaging the post 43, which extends out from the cylindrical portion 46, in the engaging hole 52.

In the thus constructed pierced earring hole maintenance device of the ninth embodiment, the earlobe 5 is gripped between the flange 47 and the cut away surface 50 of the fastener 11 by directly engaging the fastener 11 through the cut away surface 50 with the post 43, which projects out from the cylindrical portion 46. As a result, it becomes possible to ensure that the pierced earring body 42, the maintenance device body 45 and the fastener 11 are prevented from falling from the earlobe 5. In other words, because the fastener 11, which consists of a resin, is made to directly engage at the engaging aperture 52 thereof with the metallic post 43 of the pierced earring body 42, the engagement strength of this resin-metal engagement is greater than in the case of a resin-resin engagement. Further, even in the case where the diameter of the post 43 is small and space remains between this post 43 and the cylindrical portion 46 of the maintenance body 45, because this is not significant, it becomes possible to obtain sufficient engaging strength. Moreover, even in the case where the length of the post 43 of the pierced earring body 42 is not fixed (pierced earring posts 43 are ordinarily of varying lengths), it is possible to utilize the same maintenance device 45 without necessitating a change in the length of the cylindrical portion Moreover, in the ninth embodiment of the present invention, due to the provision of a tapered portion 49 to the end of the cylindrical portion 46, even if a post 43 having a narrow diameter is inserted into the cylindrical portion 46, because there is no free space between the post 43 and the tapered portion 49, when the maintenance device 45 into which the post 43 of the pierced earring body 42 has been inserted is inserted into the earlobe 5, it is possible to achieve a smooth and secure engagement. This is identical to the situation wherein the fastener 11 interlocks with the post 43.

Further, due to the grooves 54 formed in the cut away surface 50 of the fastener 11, the fluid which initially flows out when a small hole is opened in the earlobe 5 can be satisfactorily expelled to the outside.

Each of the preceding preferred embodiments of the present invention were explained using an example wherein a pierced earring is attached to the earlobe, however, the present invention may of course be utilized at a variety of other positions of attachment. Further, for the pierced earring hole maintenance device of the forms shown in FIGS. 1 through 8, the examples offered utilized the fastener shown in FIGS. 9 through 11, however, it is of course also possible to utilize the fastener shown in FIGS. 16 through 18.

What is claimed:

1. A pierced earring hole maintenance device comprising of a resin material, said pierced earring hole maintenance device further comprising:

a rod portion, suitable for insertion into a small opening formed at a position of attachment of a pierced earring to an earlobe, the rod portion further comprising liquid holding sections for holding a liquid and being formed to the external periphery of said rod, said liquid holding sections constructed of encircling grooves formed about the circumference of said rod, and straight grooves formed along the length of said rod;

a flange portion provided at one end of said rod portion and having a maximum width greater than the size of said rod portion; and a fastener having an engaging hole into which said rod portion is inserted, said fastener being detachably engaged to the other end of said rod portion, said fastener and said flange being capable of gripping said position of attachment of the pierced earring therebetween, said fastener provided with a whirl back having a roughened surface for preventing rotation of said pierced earring hole maintenance device with respect to the earlobe by holding the earlobe between said roughened surface of said fastener and said flange.

2. A pierced earring hole maintenance device comprising a resin material into which a post of a pierced earring can be removably inserted, said pierced earring hole maintenance device suitable for insertion into a hole formed at the position of attachment of the pierced earring to an earlobe, said pierced earring hole maintenance device further comprising:

a cylindrical portion open at one end thereof and closed at the other end thereof, said post of said pierced earring being removably inserted into said open end of said cylindrical portion;

a flange provided to the open end of said cylindrical portion, said flange having a maximum width greater than said cylindrical portion; and a fastener having an engaging hole into which said cylindrical portion is inserted, said fastener being detachably engaged to said closed end of said cylindrical portion, said fastener and said flange being capable of gripping said position of attachment of a pierced earring therebetween, said fastener provided with a whirl back having a matte finish as a roughened surface for preventing rotation of said pierced earring hole maintenance device with respect to the earlobe by holding the earlobe between said roughened surface of said fastener and said flange.

3. A pierced earring hole maintenance device comprising a resin material into which a post of a pierced earring can be removably inserted, said pierced earring hole maintenance device suitable for insertion into a small hole formed at the position of attachment of the pierced earring to the earlobe, said pierced earring hole maintenance device further comprising:

a main body part having a cylindrical portion into which said post of said pierced earring can be removably inserted, said cylindrical portion having two open ends and being shorter than said post, and a flange, which is provided to a first open end of said cylindrical portion and has a maximum width greater than said cylindrical portion; and a fastener having an engaging hole into which said post of said pierced earring is engaged, said fastener which engages detachably with said post which projects out from a second open end of said cylindrical portion, said fastener provided with a whirl back having a matte finish as a roughened surface for preventing rotation of said pierced earring hole maintenance device with respect to the earlobe by holding the earlobe between said roughened surface of said fastener and said flange.

4. A pierced earring hole maintenance device comprising a resin material into which a post of a pierced earring can be removably inserted, said pierced earring hole maintenance device suitable for insertion into a small hole formed at the position of attachment of the pierced earring to the earlobe, said pierced earring hole maintenance device further comprising;

a main body part having a cylindrical portion into which said post of said pierced earring can be removably inserted, said cylindrical portion having two open ends and being shorter than said post, and a flange, which is provided to a first open end of said cylindrical portion and has a maximum width greater than said cylindrical portion; and a fastener having an engaging hole into which said post of said pierced earring is engaged, said fastener which engages detachably with said post which projects out from a second open end of said cylindrical portion, said fastener is provided with a whirl back having a groove which is recessed along a radial direction from said engaging hole as a roughened surface for preventing rotation of said pierced earring hole maintenance device with respect to the earlobe by holding the earlobe between said roughened surface of said fastener and said flange.

5. A pierced earring hole maintenance device consisting of a resin material, said pierced earring hole maintenance device comprising:

a rod portion, suitable for insertion into a small opening formed at a position of attachment of a pierced earring to an earlobe, a flange portion provided at one end of said rod portion and having a maximum width greater than the size of said rod portion; and a fastener having an engaging hole into which said rod portion is inserted, said fastener is provided with a whirl back having a groove which is recessed along a radial direction from said engaging hole for preventing rotation of said pierced earring hole maintenance device with respect to the earlobe by holding the earlobe between said whirl back of said fastener and said flange.

6. A pierced earring hole maintenance device consisting of a resin material, said pierced earring hole maintenance device further comprising:

a rod portion, suitable for insertion into a small opening formed at a position of attachment of a pierced earring to an earlobe, a flange portion provided at one end of said rod portion and having a maximum width greater than the size of said rod portion; and a fastener having an engaging hole into which said rod portion is inserted, said fastener being detachably engaged to the other end of said rod portion, said fastener is provided with a matte finished whirl back for preventing rotation of said pierced earring hole maintenance device with respect to the earlobe by holding the earlobe between said whirl back of said fastener and said flange.

* * * * *